US011657934B2

(12) United States Patent
Nagamine et al.

(10) Patent No.: US 11,657,934 B2
(45) Date of Patent: May 23, 2023

(54) R-T-B BASED PERMANENT MAGNET

(71) Applicant: TDK CORPORATION, Tokyo (JP)

(72) Inventors: Yuki Nagamine, Tokyo (JP); Masashi Miwa, Tokyo (JP); Yoshinori Fujikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 414 days.

(21) Appl. No.: 16/367,917

(22) Filed: Mar. 28, 2019

(65) Prior Publication Data

US 2019/0304640 A1 Oct. 3, 2019

(30) Foreign Application Priority Data

Mar. 29, 2018 (JP) ..... JP2018-065942
Mar. 13, 2019 (JP) ..... JP2019-046405

(51) Int. Cl.

| | |
|---|---|
| ***H01F 1/057*** | (2006.01) |
| ***C22C 38/16*** | (2006.01) |
| ***C22C 38/10*** | (2006.01) |
| ***C22C 38/00*** | (2006.01) |

(Continued)

(52) U.S. Cl.

CPC ..... *H01F 1/0577* (2013.01); *C22C 38/002* (2013.01); *C22C 38/005* (2013.01); *C22C 38/06* (2013.01); *C22C 38/10* (2013.01); *C22C 38/16* (2013.01); *C22C 2202/02* (2013.01); *H01F 41/0293* (2013.01)

(58) Field of Classification Search

CPC ... H01F 1/0577; H01F 41/0293; C22C 38/16; C22C 38/10; C22C 38/005; C22C 38/002; C22C 38/06; C22C 2202/02

See application file for complete search history.

(56) References Cited

U.S. PATENT DOCUMENTS

2008/0245442 A1 10/2008 Nakamura et al.
2011/0150691 A1 6/2011 Nakamura et al.

(Continued)

FOREIGN PATENT DOCUMENTS

CN 104137197 A 11/2014
JP 2015-057820 A 3/2015
WO 2006/043348 A1 4/2006

*Primary Examiner* — Keith Walker
*Assistant Examiner* — Adil A. Siddiqui
(74) *Attorney, Agent, or Firm* — Oliff PLC

(57) ABSTRACT

An R-T-B based permanent magnet, excellent in magnetic properties relatively reducing amount of heavy rare earth element used, wherein R represents rare earth element, T iron group element and B boron, includes main phase grains including $R_2T_{14}B$ crystal phase and grain boundaries between main phase grains. Grain boundaries include R—O—C—N concentrated parts where concentrations of R, O, C and N are all higher than in main phase grains. O/R(S)>O/R(C) wherein O/R(S) represents O/R ratio (atomic ratio) in R—O—C—N concentrated parts in a surface of an R-T-B based permanent magnet and O/R(C) represents O/R ratio (atomic ratio) in R—O—C—N concentrated parts in a center of an R-T-B based permanent magnet. A heavy rare earth element RH is in a surface of an R-T-B based permanent magnet as R. R—O—C—N concentrated parts in a surface of an R-T-B based permanent magnet have RH/R ratio (atomic ratio) of 0.2 or less.

12 Claims, 5 Drawing Sheets

(51) Int. Cl.
*C22C 38/06* (2006.01)
*H01F 41/02* (2006.01)

(56) References Cited

U.S. PATENT DOCUMENTS

2015/0155083 A1* 6/2015 Miwa ..... C22C 38/14
335/302
2015/0235750 A1 8/2015 Miwa et al.

* cited by examiner

R-T-B BASED PERMANENT MAGNET

BACKGROUND OF THE INVENTION

The present invention relates to an R-T-B based permanent magnet.

An R-T-B based permanent magnet is known to have excellent magnetic properties. Recently, further improvement in the magnetic properties has been demanded.

For example, Patent document 1 discloses that particularly coercivity is further improved by allowing a compound containing a heavy rare earth element(s) to attach to a surface of an R-T-B based permanent magnet and heat to diffuse the heavy rare earth element(s) in the grain boundaries of the R-T-B based permanent magnet. However, in the method described in this publication, segregation of the heavy rare earth element(s) in the grain boundaries sometimes occurs. Likewise, the heavy rare earth element(s) cannot be efficiently diffused and a coercivity improvement effect is not efficiently exerted in some cases.

Patent document 1: WO 2006/043348 A1

BRIEF SUMMARY OF INVENTION

An object of the present invention is to provide an R-T-B based permanent magnet excellent in magnetic properties (coercivity HcJ and residual magnetic flux density Br) by diffusing a heavy rare earth element in the magnet while reducing an amount thereof used.

The R-T-B based permanent magnet of the present invention is an R-T-B based permanent magnet, in which R represents a rare earth element, T represents an iron group element and B represents boron, wherein the R-T-B based permanent magnet includes main phase grains including an $R_2T_{14}B$ crystal phase and grain boundaries formed between the main phase grains;

the grain boundaries include R—O—C—N concentrated parts where the concentrations of R, O, C and N are all higher than those in the main phase grains;

the following Expression (1) is satisfied;

$$O/R(S)>O/R(C) \quad \text{Expression (1)}$$

in which O/R(S) represents an O/R ratio (atomic ratio) in the R—O—C—N concentrated parts present in a surface of the R-T-B based permanent magnet and O/R(C) represents an O/R ratio (atomic ratio) in the R—O—C—N concentrated parts present in a center of the R-T-B based permanent magnet; and a heavy rare earth element RH is included in the R-T-B based permanent magnet as R; and wherein the R—O—C—N concentrated parts present in the surface of the R-T-B based permanent magnet have an RH/R ratio (atomic ratio) of 0.2 or less.

The R-T-B based permanent magnet of the present invention is excellent in magnetic properties (coercivity HcJ and residual magnetic flux density Br) while relatively reducing the amount of the heavy rare earth element used by having the above constitution.

In the R-T-B based permanent magnet of the present invention, $\Delta O/R(S) \geq 0.10$ may be satisfied, in which $\Delta O/R(S)=O/R(S)-O/R(C)$.

In the R-T-B based permanent magnet of the present invention, $\Delta O/R(S) \geq 0.20$ may be satisfied, in which $\Delta O/R(S)=O/R(S)-O/R(C)$.

In the R-T-B based permanent magnet of the present invention, $\Delta O/R(S)=0.38$ or less may be satisfied, in which $\Delta O/R(S)=O/R(S)-O/R(C)$.

In the R-T-B based permanent magnet of the present invention, $\Delta O/R(300) \geq 0.01$ may be satisfied, in which $\Delta O/R(300)=O/R(300)-O/R(C)$ and O/R(300) represents the O/R atomic ratio in the R—O—C—N concentrated parts exist at a depth of 300 μm from the surface of the R-T-B based permanent magnet.

In the R-T-B based permanent magnet of the present invention, $\Delta O/R(300)>0.10$ may be satisfied, in which $\Delta O/R(300)=O/R(300)-O/R(C)$ and O/R(300) represents an O/R atomic ratio in the R—O—C—N concentrated parts exist at a depth of 300 from the surface of the R-T-B based permanent magnet.

In the R-T-B based permanent magnet of the present invention, $\Delta O/R(300)=0.28$ or less may be satisfied, in which $\Delta O/R(300)=O/R(300)-O/R(C)$ and O/R(300) represents an O/R atomic ratio in the R—O—C—N concentrated parts exist at a depth of 300 from the surface of the R-T-B based permanent magnet.

In the R-T-B based permanent magnet of the present invention, the heavy rare earth element may be distributed such that the concentration thereof increases from the center toward the surface of the R-T-B based permanent magnet.

In the R-T-B based permanent magnet of the present invention, the following Expression (2) may be satisfied;

$$N/R(S)<N/R(C) \quad \text{Expression (2)}$$

in which N/R(S) represents an N/R ratio (atomic ratio) in the R—O—C—N concentrated parts exist in the surface of the R-T-B based permanent magnet and N/R(C) represents an N/R ratio (atomic ratio) in the R—O—C—N concentrated parts exist in the center of the R-T-B based permanent magnet.

In the R-T-B based permanent magnet of the present invention, area proportions of the R—O—C—N concentrated parts in the surface and the center of the R-T-B based permanent magnet may be 3 to 5%.

DETAILED DESCRIPTION OF INVENTION

Now, embodiment of the present invention will be described referring to the accompanying drawings. Note that, the present invention is not limited to the following embodiment.

Figure 1:
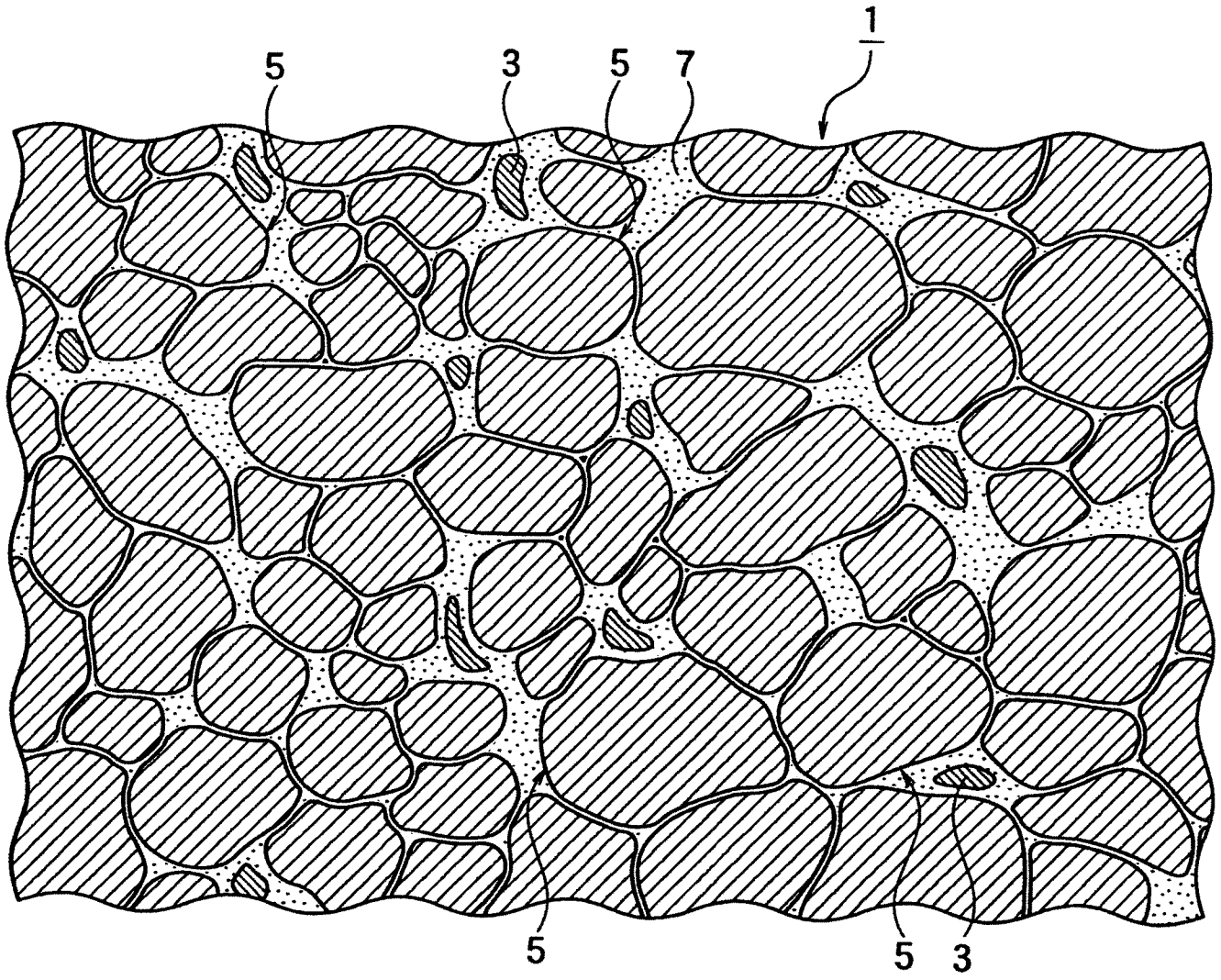
FIG. 1 is a schematic view of a cross section of the R-T-B based permanent magnet according to an embodiment of the present invention.

An R-T-B based permanent magnet 1 according to the embodiment will be described. As shown in FIG. 1, the R-T-B based permanent magnet 1 according to the embodiment has main phase grains 5 including an $R_2T_{14}B$ phase and grain boundaries 7 formed between the main phase grains 5. The grain boundaries 7 include R—O—C—N concentrated parts 3 where the concentrations of R (rare earth element), O (oxygen), C (carbon) and N (nitrogen) are all higher than those in the main phase grains 5 (almost the centers of the main phase grains 5).

The $R_2T_{14}B$ phase has a crystal structure consisting of tetragonal $R_2T_{14}B$ typed structure. Also, a phase other than the $R_2T_{14}B$ phase may be included in the main phase grain 5 and elements other than R, T and B may be included. The average grain size of the main phase grains 5 is usually about 1 μm to 30 μm. Note that, it is possible to confirm that the main phase grain 5 includes an $R_2T_{14}B$ phase by EPMA and TEM. The average grain size of the main phase grains 5 is represented by an average equivalent circle diameter of the main phase grains 5.

An R—O—C—N concentrated part 3, which exists in the grain boundaries 7 formed between two or more adjacent main phase grains 5, is a region where the concentrations of R, O, C and N are all higher than those in the main phase grains 5. The R—O—C—N concentrated part 3 may include elements other than R, O, C and N. The R—O—C—N concentrated part 3 principally exists in a grain boundary formed between three or more main phase grains (grain-boundary triple junction). Alternatively, the R—O—C—N concentrated part 3 may exist in a grain boundary formed between adjacent two main phase grains (a two-grain boundary).

In the grain boundaries 7 of the R-T-B based permanent magnet 1 according to the embodiment, a phase other than the R—O—C—N concentrated parts 3 may exist. For example, an R-rich phase having an R concentration of 70 at % or more is mentioned. Hereinafter, the phase and the concentrated part exist in the grain boundaries will be sometimes collectively referred to as a grain boundary phase.

R represents at least one rare earth element. The rare earth element refers to Sc, Y and a lanthanide element belonging to group 3 of the long-period periodic table. Examples of the lanthanide element include La, Ce, Pr, Nd, Sm, Eu, Gd, Tb, Dy, Ho, Er, Tm, Yb and Lu. The rare earth element is classified into a light rare earth element and a heavy rare earth element. In this application, the heavy rare earth element refers to rare earth element of atomic numbers 64 to 71; more specifically, Gd, Tb, Dy, Ho, Er, Tm, Yb and Lu; whereas, the light rare earth element refers to rare earth element excepts the heavy rare earth element. In this application, Y is classified into a light rare earth element. Hereinafter, a heavy rare earth element will be sometimes referred to as RH. The R-T-B based permanent magnet 1 according to the embodiment contains a heavy rare earth element as RH.

T represents an iron group element. T may be Fe alone, and part of Fe may be substituted by Co. If part of Fe is substituted by Co, the temperature characteristics and corrosion resistance can be improved without degrading magnetic properties.

B represents boron. Part of boron may be substituted by carbon. If part of boron is substituted by carbon, in other words, if boron and carbon are contained as B site, a thick two-grain boundary can be easily formed in an aging process and the coercivity is effectively improved. Note that, the amount of substitution when part of boron is substituted by carbon may be about 20 at % or less of the total B content contained in the $R_2T_{14}B$ phase.

The R-T-B based permanent magnet 1 according to the embodiment may include other elements. For example, the other elements, Ti, V, Cr, Mn, Ni, Cu, Zr, Nb, Mo, Hf, Ta, W, Al, Ga, Si, Bi and Sn may be mentioned.

In the R-T-B based permanent magnet 1 according to the embodiment, the R content is not limited. The R content may be 26 wt % or more and 33 wt % or less.

In the R-T-B based permanent magnet 1 according to the embodiment, the B content is not limited. The content of boron contained as B may be 0.8 wt % or more and 1.2 wt % or less.

In the R-T-B based permanent magnet 1 according to the embodiment, the T content is substantially balance of constituents of the R-T-B based permanent magnet 1. If Co is contained as T, the Co content may be 3.0 wt % or less relative to the total content of iron group elements. If Ni is contained as T, the Ni content may be 1.0 wt % or less relative to the total content of iron group elements.

In the R-T-B based permanent magnet 1 according to the embodiment, the content of oxygen (O) is not limited; for example, the O content may be 300 ppm or more and 3000 ppm or less. The O content is preferably high in order to improve corrosion resistance; whereas the O content is preferably low in order to improve magnetic properties.

In the R-T-B based permanent magnet 1 according to the embodiment, the content of carbon (C) is not limited. The C content, for example, may fall within the range of 300 ppm or more and 3000 ppm or less. If the C content is outside the range, the magnetic properties tend to degrade. As described above, carbon may be contained in the R-T-B based permanent magnet 1 by constituting a part of boron in B site in the R-T-B based permanent magnet 1 by carbon.

In the R-T-B based permanent magnet 1 according to the embodiment, the content of nitrogen (N) is not limited. The N content thereof may fall, for example, within the range of 200 ppm or more and 1500 ppm or less. If the N content is outside the range, magnetic properties tend to degrade.

The contents of O, C and N in the R-T-B based permanent magnet 1 can be measured by methods usually known. The O content is measured, for example, by the inert gas fusion-nondispersive infrared absorption method. The C content is measured, for example, by the combustion in oxygen stream-infrared absorption method. The N content is measured, for example, by the inert gas fusion-thermal conductivity method.

In the R-T-B based permanent magnet 1 according to the embodiment, the R—O—C—N concentrated parts 3 may almost uniformly distribute over the entire magnet. The area proportion of the R—O—C—N concentrated parts 3 in a cross section of the R-T-B based permanent magnet 1 may be not limited; however, the proportion may be about 1 to 5%, and preferably 3 to 5% in the surface and the center.

In the R-T-B based permanent magnet 1 according to the embodiment, the area proportion of the R—O—C—N concentrated parts 3 can be evaluated by analyzing the elements of a polished cross section (observation surface 16 described later) of the R-T-B based permanent magnet 1 by use of an electron probe microanalyzer (EPMA) and analyzing the resultant elemental analysis image. More specifically, first, the R-T-B based permanent magnet 1 is cut to obtain a cross section, and the cross section is polished to obtain a polished cross section. A position of cutting is not limited. Then, an observation field is set in the polished cross section, and an element distribution image in the observation field is obtained. The shape of the observation field may be appropriately determined depending on, e.g., the sizes and dispersion states of grain boundary phases contained in the R-T-B based permanent magnet 1. Owing to the elemental analysis image, the distribution state of individual elements and the distribution state of the main phase and individual grain boundary phases can be found. The region, which exists in the grain boundaries 7 formed between two or more adjacent main phase grains 5 and contains R, O, C and N all in higher concentrations than those in the main phase grains 5, is determined as the R—O—C—N concentrated part 3. The area proportion of the R—O—C—N concentrated parts 3 can be calculated based on an elemental analysis image, which is obtained by observing the observation field by an EPMA, and a backscattered electron image, which is obtained by observing the same observation field by an SEM, by using image analysis software. Using the image analysis software, the proportion of the area of the R—O—C—N concentrated parts 3 to the area of the entire observation field is calculated. The area proportion used herein refers to the area proportion of the R—O—C—N concentrated parts 3 to the entire observation field including not only the grain boundaries 7 but also the main phase grains 5.

The ratio of the R content to the total content of O, C and N in the R—O—C—N concentrated parts 3 is about 50:50 on an atomic ratio. Note that the measured values vary depending on the analysis method. If analysis is carried out, for example, by an EPMA, the atomic ratio may sometimes shift from 50:50 to approximately 40:60.

Provided that the total atomic concentration of O, C and N contained in the R—O—C—N concentrated parts 3 is 100 at %, the 0 atomic concentration is about 30 to 60 at %; the C atomic concentration is about 10 to 30 at %; and the N atomic concentration is about 10 to 50 at %.

In the R-T-B based permanent magnet 1 according to the embodiment, a heavy rare earth element RH passes through the grain boundaries 7 and forms a RH rich shell in the outer edge of the main phase grains 5. Note that, the RH rich shell is contained in the main phase grains 5. In this case, particularly coercivity HcJ increases. Since coercivity HcJ increases even by a small amount of heavy rare earth element RH compared to the case where the heavy rare earth element RH is contained in the whole main phase grains 5, the cost is low and relatively high residual magnetic flux density Br can be maintained.

However, the content of heavy rare earth element RH incorporated into the R—O—C—N concentrated parts 3 is large, with the result that the content of the heavy rare earth element RH exist in the outer edge of the main phase grains 5 decreases. Because of this, the existence of the R—O—C—N concentrated parts 3 becomes a factor for decreasing the RH concentration of the RH rich shell formed in the outer edge of the main phase grains 5. Further, the heavy rare earth element RH incorporated in the R—O—C—N concentrated parts 3 rarely contributes to improvement of coercivity HcJ. Herein, the higher the O concentration of the R—O—C—N concentrated parts 3 before an RH diffusion step described later, the smaller the amount of the heavy rare earth element RH incorporated by the R—O—C—N concentrated parts 3. However, if the O concentration in the R—O—C—N concentrated parts 3 is increased in the entire R-T-B based permanent magnet 1, the area proportion of the R—O—C—N concentrated parts 3 increases. As described above, an R—O—C—N concentrated part 3 principally exists in the grain-boundary triple junction. As a result, the R content contributing to formation of two-grain boundary decreases and the width of the two-grain boundary is reduced. Accordingly, it is more difficult for the heavy rare earth element RH to pass through the two-grain boundary and it is more difficult for the RH rich shell to be formed in the outer edge of the main phase grains 5.

The present inventors found that the content of the heavy rare earth element incorporated in the R—O—C—N concentrated parts in the surface and near the surface of the R-T-B based permanent magnet 1 can be reduced by increasing the concentration of O in the R—O—C—N concentrated parts 3 present in the surface of the R-T-B based permanent magnet 1 compared to that in the center of the R-T-B based permanent magnet 1; at the same time, the width of the two-grain boundary can be sufficiently kept. As a result, even if the content of heavy rare earth element RH is low particularly in the surface of the R-T-B based permanent magnet 1, coercivity HcJ is improved and high residual magnetic flux density Br can be maintained.

More specifically, the following Expression (1):

$$O/R(S)>O/R(C) \quad \text{Expression (1)}$$

is satisfied, wherein O/R(S) represents the O/R ratio (atomic ratio) in the R—O—C—N concentrated parts 3 present in the surface of the R-T-B based permanent magnet 1 and O/R(C) represents the O/R ratio (atomic ratio) of the R—O—C—N concentrated part 3 present in the center of the R-T-B based permanent magnet 1. Preferably, $\Delta O/R(S) \geq 0.10$ is satisfied, and further preferably, $\Delta O/R(S) \geq 0.20$ is satisfied, wherein $\Delta O/R(S)=O/R(S)-O/R(C)$. The upper limit of $\Delta O/R(S)$, which is not particularly determined, may be 0.38 or less.

The RH/R ratio (atomic ratio) in the R—O—C—N concentrated parts 3 present in the surface of the R-T-B based permanent magnet 1 is 0.2 or less. More specifically, since the concentration of O is large in the R—O—C—N concentrated parts 3 present in the surface of the R-T-B based permanent magnet 1, RH is not trapped in the surface and diffuses over the entire portion. As a result, the concentration of RH in the R—O—C—N concentrated parts 3 present in the surface of the R-T-B based permanent magnet 1 becomes low. More specifically, a relatively small content of RH efficiently works to increase coercivity HcJ of the R-T-B based permanent magnet 1.

Note that, the surface of the R-T-B based permanent magnet 1 herein include the region within the range from the surface of the R-T-B based permanent magnet 1 to a depth of 50 μm. Provided that the distance between two magnetic pole faces of the R-T-B based permanent magnet 1 (magnet surface through which most of the magnetic field lines produced by a magnet pass) is represented by d, the center of the R-T-B based permanent magnet 1 is defined as the range within a distance from one of the magnetic pole faces satisfying $(d/2)\pm(d/10)$.

Further preferably, provided that the O/R atomic ratio of the R—O—C—N concentrated parts 3 present at a depth of 300 μm from the surface of the R-T-B based permanent magnet 1 is represented by O/R(300), and $\Delta O/R(300)=O/R(300)-O/R(C)$, $\Delta O/R(300) \geq 0.01$ is satisfied. Preferably, $\Delta O/R(300)>0.10$ is satisfied, and further preferably, $\Delta O/R(300)>0.15$ is satisfied. The upper limit of $\Delta O/R(300)$ is not particularly determined, and the upper limit of $\Delta O/R(300)$ may be 0.28 or less.

Note that, the portion present at a depth of 300 μm from the surface of the R-T-B based permanent magnet 1 includes a portion present at a depth within the range of 300 μm to 350 μm. In the specification, the portion at a depth of X μm from the surface of the R-T-B based permanent magnet 1 usually refers to a portion from a depth of X μm from the surface of the R-T-B based permanent magnet 1 to a depth (X+50) μm.

Further preferably, a heavy rare earth element is distributed such that the concentration thereof increases from the center of the R-T-B based permanent magnet 1 toward the surface thereof.

Further preferably, the following Expression (2):

$$N/R(S)<N/R(C) \quad \text{Expression (2)}$$

is satisfied, wherein N/R(S) represents an N/R ratio (atomic ratio) in the R—O—C—N concentrated parts 3 present in the surface of the R-T-B based permanent magnet 1 and N/R(C) represents an N/R ratio (atomic ratio) in the R—O—C—N concentrated parts 3 present in the center of the R-T-B based permanent magnet 1.

Now, methods for determining the O/R ratio, N/R ratio, RH/R ratio of the R—O—C—N concentrated parts 3 at individual depths will be described; but are not limited to the methods described below.

Figure 2:
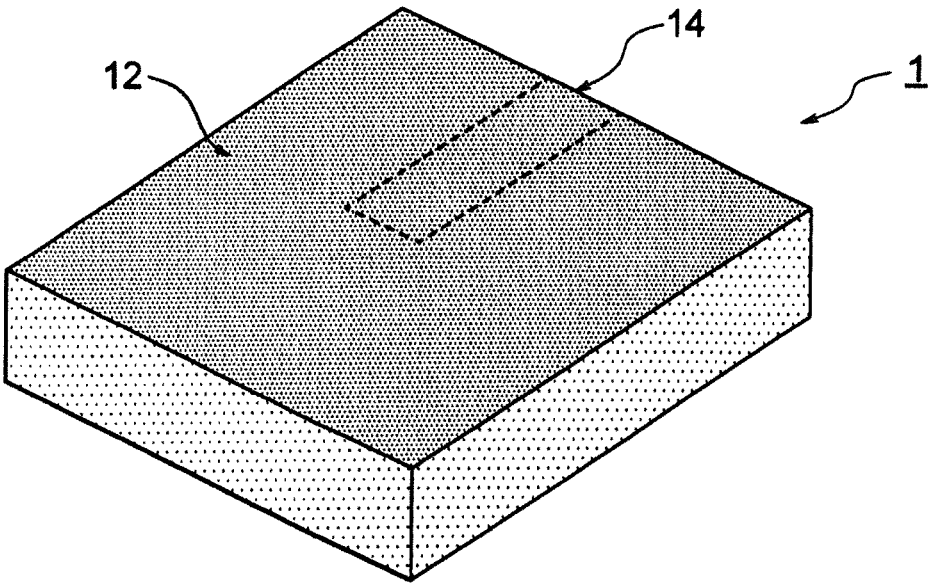
FIG. 2 is a schematic view of a position at which an R-T-B based permanent magnet is cut out on sampling.

First, in order to observe the structure of a magnet, the R-T-B based permanent magnet 1 is machined. If the R-T-B based permanent magnet 1 is magnetized, thermal demagnetization is applied. The temperature for the thermal demagnetization may be set at, for example, 350° C. or less. From the R-T-B based permanent magnet 1, a measurement sample is cut out such that a cross section containing two magnetic pole faces 12 that face to each other can be observed. For example, a measurement sample 14 is cut out from the R-T-B based permanent magnet 1, as shown in FIG. 2.

Figure 3:
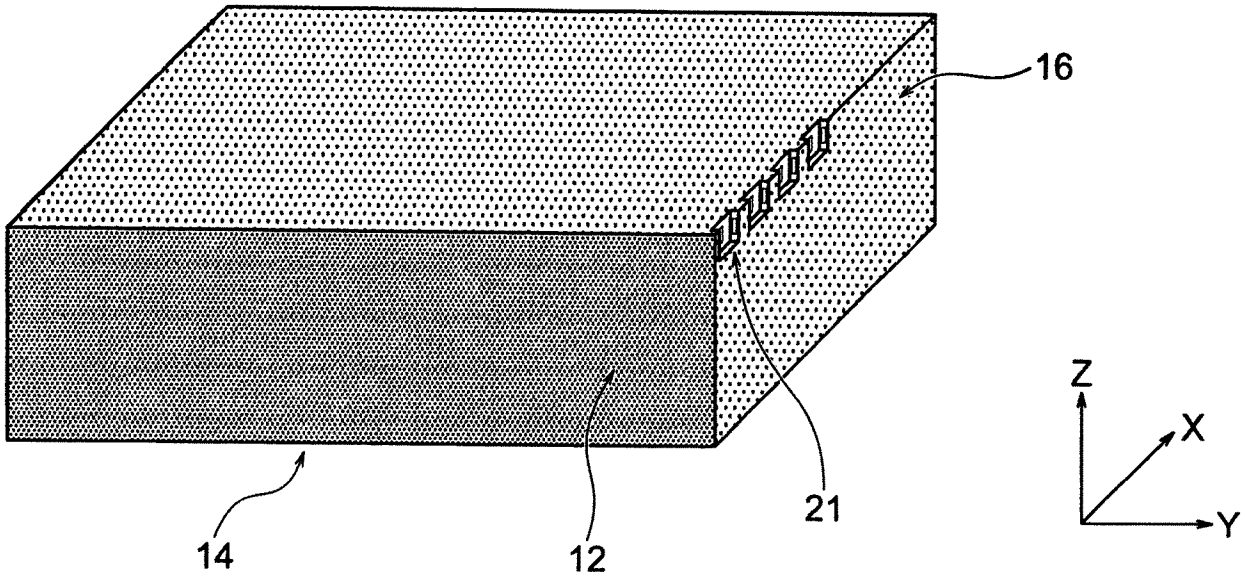
FIG. 3 is a schematic view of positions to be processed with ion beam.
Figure 4:
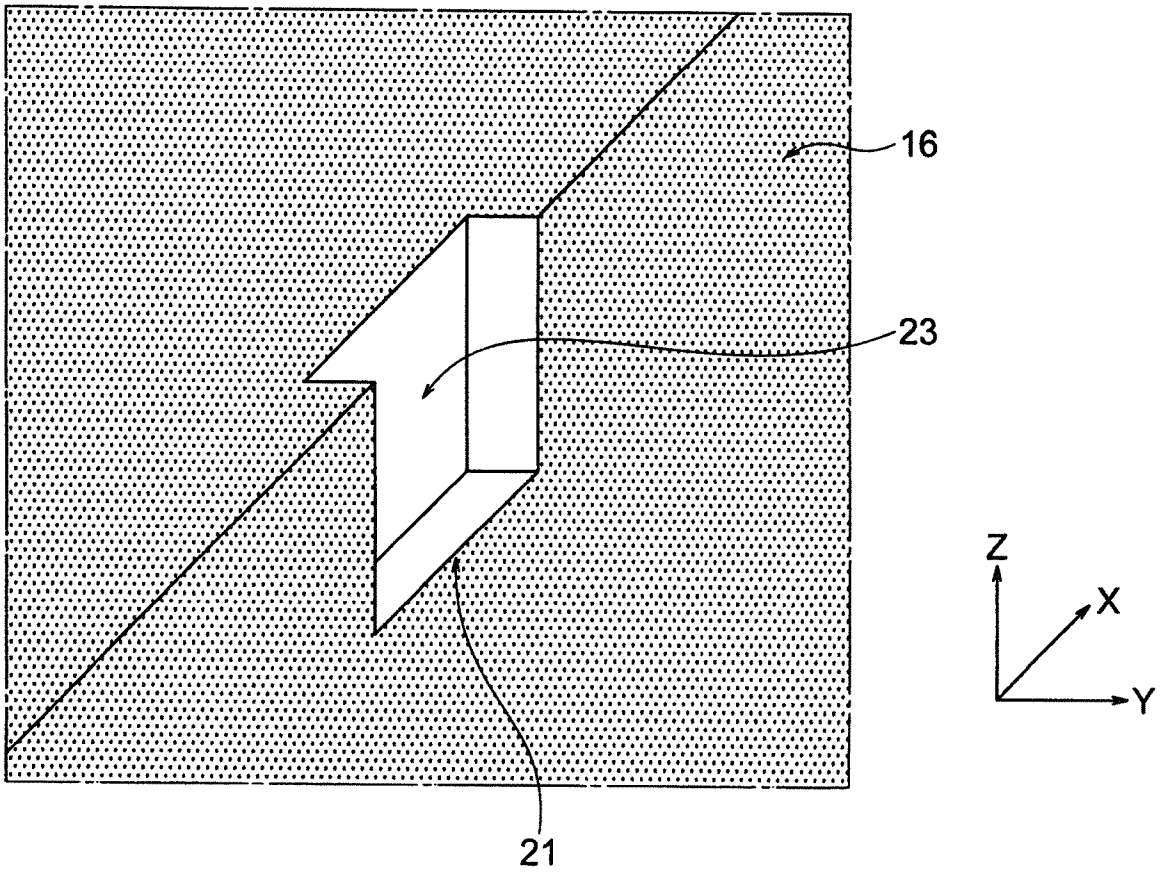
FIG. 4 is an enlarged schematic view of positions to be processed with ion beam of FIG. 3.

Of the surface of the measurement sample 14, one of the cross sections obtained by cutting out as mentioned above and containing two magnetic pole faces 12 is defined as an observation surface 16. Portion from the observation surface 16 to a depth to 1 mm is cut off by roughly polishing and subjected to finish polishing to obtain a glossy surface. Note that, in the finish polishing, dry polishing using no polishing liquid such as water is preferably employed. This is because if a polishing liquid such as water is used, the R—O—C—N concentrated parts 3 are easily hydroxylated. The R—O—C—N concentrated parts 3 hydroxylated in an ion beam processed surface 23 are removed by ion beam processing described later. However, if a polishing liquid such as water is used, since a large amount of the R—O—C—N concentrated parts 3 is hydroxylated, with the result that the concentrated parts 3 cannot be sufficiently removed and proper analysis sometimes cannot be made. Thereafter, to the observation surface 16 to which finish polishing was applied, ion beam processing is applied by a focused ion beam scanning electron microscope (hereinafter referred to as "FIB-SEM") in vacuum. By the ion beam processing, an ion beam processed section 21 containing an ion beam processed surface 23 as shown in FIG. 3 and FIG. 4 is formed. The ion beam processing by the FIB is carried out by applying an ion beam in the negative direction of Z axis shown in FIG. 3 and FIG. 4. FIG. 4 is an enlarged view of the ion beam processed section 21 shown in FIG. 3. In FIG. 3 and FIG. 4, the X axis direction is along the depth direction from the surface (magnetic pole face 12) of the R-T-B based permanent magnet 1. Along the X axis direction, the ion beam processed sections 21 are formed. Note that, the ion beam processed sections 21 are formed such that the ion beam processed surface 23 keeps a distance of 3 μm or more from the observation surface 16 in the negative direction of Y axis. An observation field of 100 μm or more×100 μm or more is provided in the ion beam processed surface 23 of each ion beam processed section 21. The ion beam processing may be applied in two stages, i.e., roughing machining and finish machining. The ion beam processing is applied separately to the observation regions different in depth so as to obtain an observant field of 100 μm or more×100 μm or more.

Conditions for the ion beam processing are not limited. As the type of ion, for example, gallium is mentioned. If gallium is used, roughing machining and finish machining are carried out at an accelerating voltage of 30 to 40 kV and a current value of 50 pA to 200 nA. If ions except gallium are used, the accelerating voltage and current value are appropriately changed.

Then, an observation field is provided in each of the ion beam processed surfaces 23 that the ion beam processed sections 21 have and machined by ion beam and different in depth, and observed by use of the function of a scanning electron microscope (SEM) of the FIB-SEM at a magnification of 500× or more and 5000× or less. Then, the R—O—C—N concentrated parts 3 are specified in each of ion beam processed surfaces 23 different in depth. In each of the ion beam processed surfaces 23 different in depth, at least 5 R—O—C—N concentrated parts 3 having a diameter (equivalent circle diameter) of 2 μm or more are specified. Note that if 5 or more R—O—C—N concentrated parts 3 having a diameter (equivalent circle diameter) of 2 μm or more cannot be specified, at least 5 R—O—C—N concentrated parts 3 including an R—O—C—N concentrated part(s) 3 having a diameter (equivalent circle diameter) of 1.0 μm or more and less than 2 μm, are specified. Note that, the circle equivalent diameter herein refers to the diameter of a circle having the same area as that of a concentrated part. Whether the concentrations of R, O, C and N in the R—O—C—N concentrated parts 3 are higher than those in the main phase grain 5 is confirmed. The concentrations of R, O, C and N can be easily confirmed by use of an energy dispersive X-ray spectrometer (EDS) attached to the FIB-SEM or a wavelength-dispersive X-ray spectrometer (WDS).

A point analysis is carried out by use of an EPMA with respect to the portion near the center of each of the R—O—C—N concentrated parts 3 specified. Herein, the measurement sample 14 is transferred from the FIB-SEM to the EPMA. When the sample is introduced in the EPMA, it is important not to expose the sample to the atmosphere or, if exposed, exposure time must be short.

In the R-T-B based permanent magnet 1 of the embodiment, if the R—O—C—N concentrated parts 3 are exposed to the atmosphere, $H_2O$ in the atmosphere reacts with the R—O—C—N concentrated parts 3. If so, N is converted into ammonia and then vaporized. As a result, the composition of the R—O—C—N concentrated part 3 cannot be accurately measured.

In the point analysis using an EPMA, at least 5 R—O—C—N concentrated parts 3 which are specified per ion beam processed surface 23 are used and analysis is made on a point near the center thereof. The O/R ratios, N/R ratios and RH/R ratios in individual R—O—C—N concentrated parts 3 subjected to the point analysis are calculated and averaged. In this manner, the O/R ratio, N/R ratio and RH/R ratio of the R—O—C—N concentrated parts 3 at each depth are computationally obtained. At this time, average O/R ratio, N/R ratio and RH/R ratio may be obtained after the largest value and smallest value of point analysis results are eliminated.

The R-T-B based permanent magnet 1 according to the embodiment can be machined into any shape, and then, put in use. Examples of the shape may include a columnar shape such as a cuboid, a hexahedron, a tabular shape and a quadratic prism; and a cylindrical shape having a C-letter sectional shape. Examples of the quadratic prism may include a quadratic prism having a rectangle bottom and quadratic prism having a square bottom.

The R-T-B based permanent magnet 1 according to the embodiment includes both a magnet product obtained by machining a magnet followed by magnetizing it and a magnet product obtained from the magnet without magnetizing it.

<Method for Producing R-T-B Based Permanent Magnet>

A method for producing R-T-B based permanent magnet according to the embodiment having the aforementioned structure will be described. A method for producing R-T-B based permanent magnet according to the embodiment has the following steps.

(a) an alloy preparation step of preparing a raw material alloy (b) a pulverization step of pulverizing the raw material alloy (c) a molding step of molding the raw material alloy pulverized (e) a sintering step of sintering a green compact to obtain an R-T-B based permanent magnet body (f) a machining step of machining the R-T-B based permanent magnet body (g) an oxidation step of oxidizing R—O—C—N concentrated parts present in the surface of the R-T-B based permanent magnet body (h) a diffusion step of diffusing a heavy rare earth element in the grain boundaries of the R-T-B based permanent magnet body (i) an aging treatment step of aging the R-T-B based permanent magnet (j) a cooling step of cooling the R-T-B based permanent magnet (k) a surface treatment step of treating the surface of the R-T-B based permanent magnet.

[Alloy Preparation Step]

A raw material alloy for the R-T-B based permanent magnet according to the embodiment is prepared. Raw material metals corresponding to the composition of the R-T-B based permanent magnet according to the embodiment are melted in vacuum or an atmosphere of an inert gas such as Ar gas, and then, the raw material metals melted are casted to prepare a raw material alloy having a desired composition. Note that, in the embodiment, a single alloy method will be described; however, a two-alloy method, i.e., an alloy for main phases and an alloy for grain boundaries may be employed.

As the raw material metal, for example, a rare earth metal or a rare earth alloy, pure iron, ferro-boron, further an alloy and a compound of these can be used. Examples of the method for casting a raw material metal include an ingot casting method, a strip casting method, a book mold method and a centrifugal casting method. If the resultant raw material alloy has solidification segregation, if necessary, the raw material alloy is subjected to homogenization treatment. When the raw material alloy is homogenized, the raw material alloy is kept under vacuum or an inert gas atmosphere at a temperature of 700° C. or more and 1500° C. or less for one hour or more. In this manner, the alloy for an R-T-B based permanent magnet is melted and homogenized.

[Pulverization Step]

After the raw material alloy is produced, the alloy is pulverized.

The pulverization step can be carried out by two stages, i.e., a coarse pulverization step of pulverizing an alloy up to a particle size of about several hundreds of μm to several mm and a fine pulverization step of pulverizing the alloy particles up to a particle size of about a few μm.

(Coarse Pulverization Step)

The raw material alloy is coarsely pulverized until particles having a size of about several hundreds of μm to several mm are obtained. In this manner, coarsely pulverized powder is obtained. Coarse pulverizing is carried out by first allowing a raw material alloy to absorb hydrogen, and then allowing hydrogen to release based on the difference in hydrogen storage capacity between phases. The dehydrogenation thus carried out to induce self-collapsing pulverizing (hydrogen storage pulverization). In the coarse pulverization step, hydrogen storage pulverization mentioned above may not be employed, and pulverization may be carried out, for example, by use of a coarse grinder such as a stamp mill, a jaw grinder and a brown mill, in an inert gas atmosphere.

In order to obtain high magnetic properties, the steps from pulverization step to the sintering step (described later) are preferably carried out in a low oxygen-concentration atmosphere. The oxygen concentration is controlled by controlling the atmosphere in each production step. If the oxygen concentration of each production step is high, a rare earth element in raw material alloy powder is oxidized to produce an R oxide. The R oxide is not reduced during sintering and precipitates as it is in the grain boundaries, with the result that the residual magnetic flux density Br of the R-T-B based permanent magnet obtained decreases. For the reason, the oxygen concentration in each step is preferably controlled to be, for example, 100 ppm or less.

(Fine Pulverization Step)

After a raw material alloy is coarsely pulverized, the resultant coarsely pulverized raw material alloy powder is pulverized into fine particles until an average grain size of about a few μm is obtained. In this manner, pulverized powder of the raw material alloy is obtained. The coarsely pulverized powder is further pulverized into fine particles to successfully obtain pulverized powder having a size of preferably 1 μm or more and 10 μm or less and more preferably 3 μm or more and 5 μm or less.

Fine pulverization is carried out by further pulverizing the coarsely pulverized powder by means of a fine grinder such as a jet mill, a ball mill, a vibration mill and a wet attritor while appropriately controlling conditions such as pulverization time. The jet mill releases a high-pressure inert gas (for example, $N_2$ gas) from a narrow nozzle to generate a high speed gas flow accelerates coarsely pulverized powder particles of the raw material alloy by the high speed gas flow to pulverize the coarsely pulverized powder particles (of the raw material alloy) with each other, a target or a container wall, to pulverize them.

In pulverizing coarsely pulverized powder particles of the raw material alloy into fine particles, if a pulverization aid such as zinc stearate and/or oleic amide are added, pulverized fine powder exhibiting high orientation during molding can be obtained.

[Molding Step]

The pulverized fine raw-material alloy powder is pressed into a desired shape. Thereby, the green compact is obtained. In the molding step, the pulverized fine powder is filled in a press mold arranged between electromagnets and applying a pressure, thereby forms desired shape. The green compact's shape is not limited. Here, by pressurizing while applying a magnetic field, a predetermined orientation of the raw-material alloy powder is formed, and molding is done in the magnetic field while crystal axis is oriented. Since the obtained green compact is oriented in a specific direction, an R-T-B based permanent magnet body having a higher magnetic anisotropy can be obtained.

[Sintering Step]

The green compact having a desired shape obtained by molding in a magnetic field is sintered in vacuum or in inert gas atmosphere, and the R-T-B based permanent magnet is obtained. The sintering temperature herein needs to be controlled depending on various conditions such as a composition, a pulverization method, a difference between particle size and particle size distribution; for example, a green compact is sintered by heating it in vacuum or in inert gas at a temperature of 1000° C. or more and 1200° C. or less for one hour or more and 10 hours or less. In this manner, liquid phase sintering of pulverized powder can be made to obtain an R-T-B based permanent magnet body improved in main-phase volume ratio. After sintering, the R-T-B based permanent magnet body is preferably cooled rapidly in order to improve production efficiency.

If magnetic properties are measured at this point, aging treatment is applied. More specifically, the aging treatment is applied to the R-T-B based permanent magnet body by allowing the R-T-B based permanent magnet body sintered to stand still at a lower temperature than that in the sintering step. The aging treatment is applied by two heating stages including a stage of heating at a temperature, for example, 700° C. or more and 900° C. or lower for 1 to 3 hours and a stage of heating at a temperature of 500° C. to 700° C. for 1 to 3 hours, or a single heating stage at a temperature of about 600° C. for 1 to 3 hours. The conditions for aging treatment are appropriately controlled depending on the repeat number of the treatment. By the aging treatment as mentioned above, the magnetic properties of the R-T-B based permanent magnet body can be improved. Note that the aging treatment may be carried out after the machining step.

After the R-T-B based permanent magnet body subjected to aging treatment, the body is rapidly cooled in an Ar gas atmosphere. In this manner, the R-T-B based permanent magnet body according to the embodiment can be obtained. The cooling rate, which is not particularly limited, is preferably 30° C./min or faster.

[Machining Step]

The resultant R-T-B based permanent magnet body is, if necessary, machined into a desire shape. Examples of the machining method include a shape machining such as cutting and grinding, and chamfering such as barrel polishing.

[Oxidation Step]

Herein, prior to the diffusion step described later, an oxidation step of oxidizing principally the R—O—C—N concentrated parts in the surface of the R-T-B based permanent magnet body(s) is carried out. Owing to this step, the R-T-B based permanent magnet body satisfying O/R(S)>O/R(C) can be obtained.

Any method can be employed as a method for oxidizing the R—O—C—N concentrated parts in the surface of the R-T-B based permanent magnet body. For example, a method of attaching an oxide of a rare earth element (hereinafter simply referred to also as a rare earth oxide) to the surface of the R-T-B based permanent magnet body, followed by heating the body, is mentioned.

Note that, the method for attaching a rare earth oxide is not particularly limited. Examples thereof include methods using vapor deposition, sputtering, electroplating, spray application, brushing, jet dispenser, nozzle, screen printing, squeegee printing and sheet method.

The magnetic properties of the R-T-B based permanent magnet finally obtained can be suitably controlled by appropriately controlling the type, applied amount and the temperature of the heat treatment of a rare earth oxide.

If the applied amount of a rare earth oxide is excessively low, the R—O—C—N concentrated parts in the surface of the R-T-B based permanent magnet are not sufficiently oxidized and thus the coercivity HcJ improvement effect becomes low. Conversely if the applied amount of a rare earth oxide is excessively large, the R-rich phase is oxidized to narrow the width of the grain boundaries 7, with the result that the coercivity HcJ improvement effect becomes low. In addition, the residual magnetic flux density Br significantly decreases.

The type of rare earth oxide is not limited; however, a light rare earth oxide is preferably used. If an oxide of a heavy rare earth element RH is used, the content of heavy rare earth element RH tends to be excessively high; particularly, the RH/R ratio in the surface of the R-T-B based permanent magnet is excessively high. As a result, the residual magnetic flux density Br tends to decrease.

The type of light rare earth element contained in the rare earth oxide is not limited; however, Nd and/or Pr are preferable. More specifically, examples of the preferable light rare earth oxide include an Nd oxide ($Nd_2O_3$), a Pr oxide ($Pr_6O_{11}$) and a didymium oxide (a mixture of $Nd_2O_3$ and $Pr_6O_{11}$). Note that, if Nd is used, the residual magnetic flux density Br tends to increase as compared to Pr. If Pr is used, the coercivity HcJ tends to increase.

If a rare earth oxide is attached by coating, coating paste including an oxide containing a rare earth element and a solvent is usually applied. A type of the coating paste is not particularly limited.

The rare earth oxide preferably has particle form. The average grain size of the particles is preferably 100 nm to 50 μm.

As the solvent for use in the coating paste, a solvent uniformly dispersing a compound of a rare earth element without dissolving it is preferable. Examples thereof include an alcohol, an aldehyde and a ketone. Of them, ethanol is preferable.

The content of a rare earth oxide in the coating paste, which is not particularly limited, may be, for example, 50 wt % to 90 wt %. The coating paste, if necessary, may further contain a component other than the rare earth oxide. For example, a dispersant for preventing agglomeration of a rare earth oxide is mentioned.

In the oxidation step of the embodiment, a rare earth oxide is attached to the same surface (preferably magnetic pole face) as that to which a heavy rare earth compound is to be attached in a diffusion step (described later).

The applied amount of a rare earth oxide may be, for example, 0.2 wt % or more and 1.5 wt % or less based on the total amount of the R-T-B based permanent magnet as 100 wt %. The temperature of the heat treatment is preferably set to be 850° C. or more and 950° C. or less. The heat treatment time may be set to be one hour or more and 24 hours or less. The atmosphere for the heat treatment is not limited; however, the heat treatment is preferably carried out in vacuum or an Ar gas atmosphere. If the heat treatment conditions are appropriately controlled, particularly, the area proportion of the R—O—C—N concentrated parts in the surface of an R-T-B based permanent magnet is easily and suitably controlled.

After heat treatment, the surface coated with the coating paste is polished to reduce just by the thickness increased by the coating paste. If the coating paste remains, the diffusion step described later cannot be suitably carried out.

[Diffusion Step]

A heavy rare earth element RH is diffused into the grain boundaries of the R-T-B based permanent magnet body.

Since the oxidation step is carried out before the diffusion step, the amount of heavy rare earth element RH incorporated in the R—O—C—N concentrated parts particularly present in the surface of the R-T-B based permanent magnet body decreases. As a result, the coercivity HcJ improvement effect by the diffusion step increases and the residual magnetic flux density Br is suitably maintained.

Diffusion is carried out by a method of applying a heat treatment to the surface of an R-T-B based permanent magnet body after a compound containing the heavy rare earth element is attached to the surface of the body or a method of applying a heat treatment to an R-T-B based permanent magnet body in an atmosphere containing steam of a heavy rare earth element.

Note that, the method of attaching a heavy rare earth element RH is not particularly limited. Examples thereof include vapor deposition, sputtering, electroplating, spray application, brushing, jet dispenser, nozzle, screen printing, squeegee printing and sheet method.

The type of heavy rare earth element RH is not limited; however, Dy or Tb is preferably used and Tb is particularly preferably used. For example, when Tb is diffused as a heavy rare earth element RH, if the applied amount, diffusion temperature and diffusion time of Tb is appropriately controlled, a diffusion effect can be suitably obtained.

If a heavy rare earth element RH is attached by coating, coating paste containing a heavy rare earth compound including a heavy rare earth element RH and a solvent is usually applied. The condition of the coating paste is not particularly limited. The type of heavy rare earth compound is not limited. Examples thereof include an alloy, an oxide, a halide, a hydroxide and a hydride. Particularly, a hydride is preferably used.

If a Tb compound is attached, for example, a Tb hydride ($TbH_2$), a Tb oxide ($Tb_2O_3$, $Tb_4O_7$) or a Tb fluoride ($TbF_3$) is conceivably attached.

The heavy rare earth compound preferably has particle form. The average grain size thereof is preferably 100 nm to 50 μm and more preferably 1 μm to 10 μm.

As the solvent to be used in the coating paste, a solvent uniformly that can disperse a heavy rare earth compound without dissolving it is preferable. Examples thereof include an alcohol, an aldehyde and a ketone. Of them, ethanol is preferable.

The content of a heavy rare earth compound in the coating paste, which is not particularly limited, may be, for example, 50 wt % to 90 wt %. The coating paste, if necessary, may further contain a component other than the heavy rare earth compound. For example, a dispersant for preventing agglomeration of heavy rare earth compound particles is mentioned.

In the diffusion step of the embodiment, the number of the surfaces of an R-T-B based permanent magnet body to which heavy rare earth contained paste to be attached is not particularly limited. For example, the coating paste may be applied to all surfaces or only two surfaces, i.e., the largest surface and the surface facing this surface. If necessary, the surface(s) except the surface to be coated may be masked. The surface to be coated with coating paste including a heavy rare earth compound is preferably a magnetic pole face.

The applied amount of Tb can be, for example, 0.2 wt % or more and 3.0 wt % or less based on the total amount of the R-T-B based permanent magnet as 100 wt %. The temperature of the heat treatment during diffusion is preferably 800° C. or more and 950° C. or less. The heat treatment time during diffusion is preferably set to be one hour or more and 30 hours or less. The atmosphere during diffusion step is not limited; however, an Ar gas atmosphere is preferable.

[Aging Treatment Step]

After the diffusion step, the R-T-B based permanent magnet is subjected to aging treatment. After the diffusion step, the R-T-B based permanent magnet may be subjected to aging treatment in which the R-T-B based permanent magnet is allowed to stand still at a lower temperature than that during diffusion step. The aging treatment is carried out, for example, at a temperature of 450° C. or more and 600° C. or less for 0.5 hours or more and 4 hours or less; however, these conditions are appropriately controlled depending on the repeat number of aging treatments. Owing to the aging treatment, the magnetic properties of the R-T-B based permanent magnet can be improved. The atmosphere during the aging treatment is not limited; however, an Ar gas atmosphere is preferably used.

[Cooling Step]

After aging treatment is applied to the R-T-B based permanent magnet, the R-T-B based permanent magnet is cooled in an Ar gas atmosphere. In this manner, the R-T-B based permanent magnet according to the embodiment can be obtained. The cooling rate is not limited; however, the cooling rate is, for example, 30° C./minute or more and 300° C./minute or less.

[Surface Treatment Step]

The R-T-B based permanent magnet is obtained by the above steps, and it may be subjected to a surface treatment such as plating, resin coating, oxidation treatment and chemical conversion treatment depending on the use and desired property. The surface treatment step may not be applied.

The R-T-B based permanent magnet according to the embodiment is magnetized in accordance with a customary method to obtain a magnet product.

The R-T-B based permanent magnet according to the embodiment obtained in the aforementioned manner can be further improved in magnetic properties by reducing the content of a heavy rare earth element RH to be incorporated in the R—O—C—N concentrated parts present in the surface of the magnet.

In the foregoing, a preferred embodiment(s) of the R-T-B based permanent magnet of the present invention has been described; however, the R-T-B based permanent magnet of the present invention is not limited to the above embodiment (s). The R-T-B based permanent magnets of the present invention may be modified in various ways and used in various combinations without departing from the scope of the invention. The present invention can be similarly applied to other rare earth magnets.

For example, the R-T-B based permanent magnet of the present invention is not limited to an R-T-B based sintered magnet obtained by sintering as mentioned in above, and may be an R-T-B based permanent magnet produced by hot plastic processing and hot deformation instead of sintering.

When a hot plastic processing is carried out which applies pressure while heating to a cold-formed body obtained by molding the raw material powder at room temperature, pores remaining in the cold-formed body disappear, and densification can be done without sintering. When a formed body obtained by hot plastic processing is subjected to hot extrusion as hot deformation, an R-T-B based permanent magnet having a desire shape and magnetic anisotropy can be obtained. In this case, if the R-T-B based permanent magnet has the R—O—C—N concentrated parts, the R-T-B based permanent magnet of the present invention can be obtained by diffusing a heavy rare earth element in appropriate conditions.

Use of the R-T-B based permanent magnet according to the embodiment may be not limited. Examples of the use include electric cars and motors for wind power generation.

Example

The present invention will be more specifically described based on Examples; however, the present invention is not limited to Examples.

<Production of R-T-B Based Permanent Magnet Body>

First, to obtain an R-T-B based permanent magnet body having a composition of Nd: 24.5, Pr: 6.2, B: 1.0, Co: 0.5, Cu: 0.1, Al: 0.2, and Fe: balance (unit: wt %), a raw material alloy was casted by a strip casting (SC) method.

Then, the raw material alloy was carried out by absorbing, hydrogen at room temperature and then dehydrogenated at 600° C. for one hour. In this manner, hydrogen pulverization (coarse pulverization) of the raw material alloy was carried out to obtain pulverized coarse powder. Note that, individual steps (fine pulverizing and molding) from the hydrogen pulverization treatment to sintering were carried out in an atmosphere of an oxygen concentration of less than 50 ppm.

To the pulverized coarse powder of the raw material alloy, 0.2 wt % of oleic amide serving as a pulverization aid was added. The mixture was stirred by a Nauta mixer. The mixture was further subjected to pulverization by a jet mill using a high-pressure $N_2$ gas to obtain pulverized fine powder having an average grain size of about 4.0 μm.

The resultant pulverized fine powder was charged in a press mold arranged between electromagnets and molded in a magnetic field by applying a pressure of 100 MPa while applying a magnetic field of 1200 kA/m to obtain a green compact. Thereafter, the obtained green compact was sintered by keeping it in vacuum at 1050° C. for 7 hours, and then, rapidly cooled to obtain a sintered body having the aforementioned composition. The shape of the sintered body was almost a rectangular shape of about 15 mm×15 mm×5 mm. The sintered body was machined such that the axis of easy magnetization of the main phase grains was along the perpendicular direction to the surface of 15 mm×15 mm to obtain an R-T-B based permanent magnet body (hereinafter simply referred to also as a body). Since the axis of easy magnetization was along the perpendicular direction to the surface of 15 mm×15 mm, two surfaces of 15 mm×15 mm were magnetic pole faces.

Note that, the magnetic properties of the above body were measured by the method described later. As a result, the residual magnetic flux density Br thereof was 1456 mT and the coercivity HcJ was 1280 kA/m.

<Oxidation of R—O—C—N Concentrated Part>

A coating paste to be applied to a body for oxidizing R—O—C—N concentrated parts was prepared. Powder of a coating material (oxide) described in Table 1 was further pulverized by a jet mill using $N_2$ gas to prepare oxide fine powder. Note that $Nd_2O_3$ was used as an Nd oxide and $Pr_6O_{11}$ was used as a Pr oxide. As a didymium oxide, a mixture of $Nd_2O_3$ and $Pr_6O_{11}$ in a weight ratio of Nd:Pr=7:3 was used.

Subsequently, 80 parts by weight of ethanol and 20 parts by weight of polyvinyl alcohol were mixed to prepare an alcohol solvent. Then, 60 parts by weight of the oxide fine powder and 40 parts by weight of the alcohol solvent were mixed to disperse the oxide fine powder in the alcohol solvent. In this manner, a coating paste including the oxide was prepared.

To the two surfaces (15 mm×15 mm in size) of the body, the coating paste including the oxide was applied such that the total amount of the coating material (oxide) to the two surfaces satisfies the applied amount shown in Table 1. Note that, the parameter of the applied amount shown in Table 1 is the weight of the body before coating. Subsequently, a heat treatment was applied at the heat treatment temperature shown in Table 1 for 5 hours in an Ar gas atmosphere to oxidize R—O—C—N concentrated parts in the body. Thereafter, the coating surfaces (two surfaces of 15 mm×15 mm in size) were polished to remove a residual coating material on the coating surfaces. Note that, in Comparative Example 1 and Comparative Example 2, the oxide-containing coating paste was not applied and a heat treatment was not carried out.

<Diffusion of RH Element>

A coating paste to be applied to the body having R—O—C—N concentrated parts oxidized and used for diffusing an RH element, was prepared. Powder of a coating material (RH compound) described in Table 1 was further pulverized by use of a jet mill using $N_2$ gas to prepare RH fine powder. Note that, $TbH_2$ was used as a Tb hydride; $Tb_2O_3$ was used as a Tb oxide and $TbF_3$ was used as a Tb fluoride.

Subsequently, 80 parts by weight of ethanol and 20 parts by weight of polyvinyl alcohol were mixed to prepare an alcohol solvent. 60 parts by weight of the RH fine powder and 40 parts by weight of the alcohol solvent were mixed to disperse the RH fine powder in the alcohol solvent. In this manner, a RH contained paste was prepared.

To the two surfaces (15 mm×15 mm in size) of the body having the R—O—C—N concentrated parts oxidized, the RH contained paste was applied such that the total amount of the coating material (RH compound) to the two surfaces is 1 wt %. Note that, the parameter of the applied amount is the weight of the body after oxidation of the R—O—C—N concentrated parts. Subsequently, a heat treatment was carried out at 850° C. for 5 hours to diffuse the RH element. Then, an aging treatment was carried out at 550° C. for one hour. In this manner, R-T-B based permanent magnets represented by Sample Nos. in Table 1 and Table 2 were prepared. Note that the R-T-B based permanent magnets per sample were prepared as many as necessary for the following evaluations.

Now, methods for evaluating the R-T-B based permanent magnet obtained will be described.

<Magnetic Properties>

Magnetic properties (residual magnetic flux density Br and coercivity HcJ) were measured by the following method. First, two surfaces (15 mm×15 mm in size) of a body coated with the RH contained paste each were polished up to a depth of 100 μm. After the body was magnetized, the residual magnetic flux density Br and coercivity HcJ were measured by use of a B—H tracer. The results are shown in Table 1. Note that, in this Example, a residual magnetic flux density Br of 1390 mT or more was evaluated as "satisfactory"; and 1420 mT or more was evaluated as "more satisfactory". A coercivity HcJ of 1800 kA/m or more was evaluated as "satisfactory"; 1900 kA/m or more was evaluated as "more satisfactory"; and 1950 kA/m or more was evaluated as "further satisfactory".

<RH Content>

The RH content was measured by the following method. First, two surfaces (15 mm×15 mm in size) coated with the RH contained paste each were polished up to a depth of 500

μm. Subsequently, the R-T-B based permanent magnet polished was pulverized (and mixed) to obtain R-T-B based permanent magnet powder. Then, the RH content of the R-T-B based permanent magnet powder was measured by an XRF (X-ray fluorescence) spectrometer. The results are shown in Table 2.

<O/R Ratio, N/R Ratio and RH/R Ratio of R—O—C—N Concentrated Part>

The O/R ratio, N/R ratio and RH/R ratio of the R—O—C—N concentrated parts were determined by the following method. First, the R-T-B based permanent magnet after aging treatment was machined. More specifically, the R-T-B based permanent magnet 1 (15 mm×15 mm×5 mm) was cut along the dotted line shown in FIG. 2 and the R-T-B based permanent magnet (measurement sample 14) of 2 mm×7 mm×5 mm in size was cut out. Note that, when the composition of an R—O—C—N concentrated part was measured, two surfaces (magnetic pole faces 12) coated with the RH contained paste were not polished at all by us. Of the two surfaces (2 mm×5 mm) of measurement sample 14, the surface, which was a cross section present within the R-T-B based permanent magnet 1 without being exposed, was used as an observation surface 16. The observation surface 16 was roughly polished, more specifically, by use of abrasive paper (#600) up to a depth of 1 mm; and then, subjected to finish polishing, more specifically, dry polishing using abrasive paper (#3000) without using a polishing liquid such as water until a glossy surface was obtained. Note that, if a large amount of polishing waste was generated herein, the polishing waste was blown away by air blow.

Figure 5:
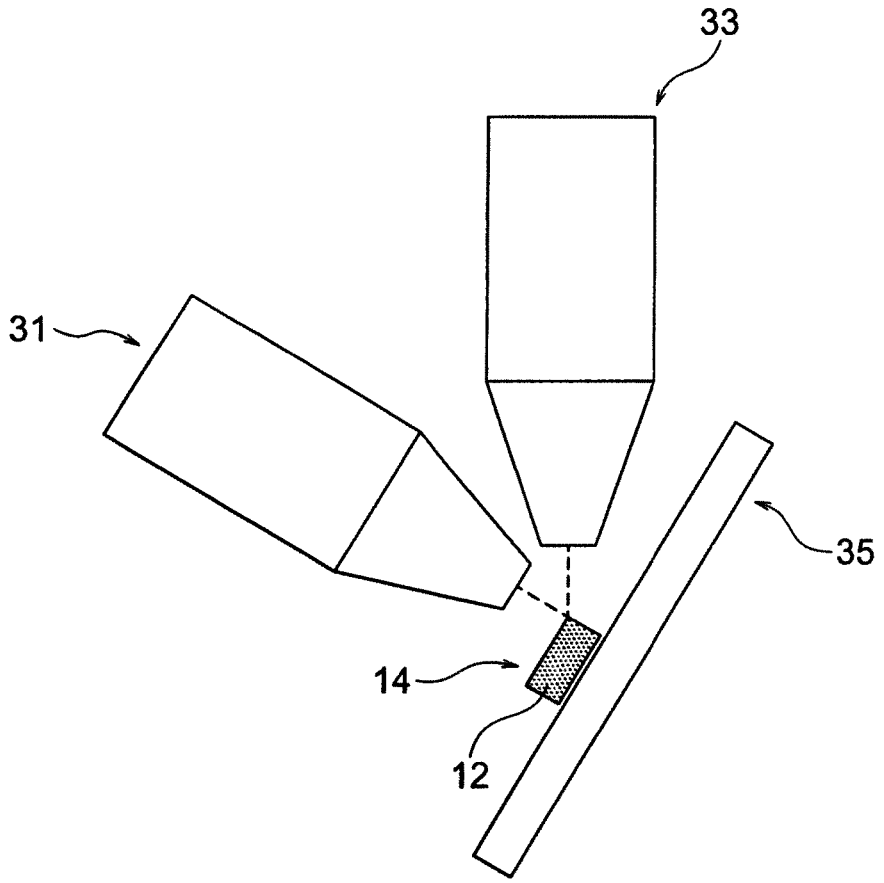
FIG. 5 is a schematic view of an FIB-SEM.

The observation surface 16 was observed by use of an FIB-SEM (Auriga, manufactured by Carl Zeiss). More specifically, first, a measurement sample 14 was fixed on a sample stage 35 of the FIB-SEM such that the observation surface 16 can be further cut and machined. At this time, conduction between the FIB-SEM and the R-T-B based permanent magnet was ensured by use of a conductive paste and/or a conductive tape. Subsequently, ion beam processing was carried out by use of ion beam of the FIB-SEM so as to obtain an ion beam processed section 21 containing an ion beam processed surface 23 having a size of 100 μm or more×100 μm or more. In this manner, the ion beam processed section 21 was formed. More specifically, an ion beam was applied from an ion gun 31 of FIB shown in FIG. 5 in the direction indicated by a dotted line to form the ion beam processed section 21. In the ion beam processing, rough machining was carried out by applying a gallium ion beam at an accelerating voltage of 30 kV and a beam current of 20 nA. Thereafter, finish machining was applied to the surface roughly machined, at an accelerating voltage of 30 kV and a beam current of 1 nA.

The ion beam processed section 21 was separately prepared in the surface, regions at a depth of 200 μm, 300 μm and 400 μm, and a center region. More specifically, in the observation surface 16, the interface between a body formed of an R-T-B based permanent magnet and the RH contained paste applied onto the body surface (magnetic pole face 12) was specified as depth of 0 μm and the portion from a depth of 0 μm to 50 μm was specified as the surface (depth of 0 μm). A portion present within a distance of 2.5 mm±500 μm from the interface formed each in the two magnetic pole faces 12 was specified as the center. The portion within a depth of 200 μm to 250 μm was specified as the region at a depth of 200 μm, the portion within a depth of 300 μm to 350 μm was specified as the region at a depth of 300 μm; and the portion within a depth of 400 to 450 μm was specified as the region of a depth 400 μm.

Subsequently, using the functions of an SEM in the FIB-SEM and an EDS attached to the FIB-SEM, the ion beam processed surface 23 was observed. More specifically, observation was carried out by applying an electron beam in the direction indicated by a dotted line from an electron gun 33 of the SEM shown in FIG. 5, more specifically, in an oblique direction to the ion beam processed surface 23. If a single observation field in the ion beam processed surface 23 was a region of 100 μm×100 in size, it was sufficient to observe. Then, the R—O—C—N concentrated parts to be subjected to composition analysis were specified in each of the regions of the ion beam processed surfaces 23 at depths of 0 μm, 200 μm, 300 μm, 400 μm and the center. The R—O—C—N concentrated part to be subjected to composition analysis was specified to have a diameter 2 μm or more. To analyze compositions of at least 5 R—O—C—N concentrated parts, if necessary, observation fields were observed at each depth.

The compositions of the R—O—C—N concentrated parts were analyzed by use of an EPMA (JXA-8500F manufactured by JEOL Ltd.). After cross sections were observed by an FIB-SEM, an R-T-B based permanent magnet (measurement sample 14) was introduced into the EPMA without exposing it to the atmosphere, or even if exposed to atmosphere, the magnet was quickly introduced to the EPMA. When the R-T-B based permanent magnet was introduced into the EPMA, sufficient conduction between the EPMA and the R-T-B based permanent magnet was ensured by use of a conductive paste and/or a conductive tape. As the analysis conditions by the EPMA, an accelerating voltage of 10 kV and an irradiation current of 100 nA were used. At the time of composition analysis of an R—O—C—N concentrated part, a substantially center portion thereof was targeted for point analysis. The point analysis refers to quantitative analysis for a region having a diameter of 0 μm for setting.

In the point analysis, the contents of 14 elements, i.e., C, N, O, Nd, Pr, Tb, Fe, Co, Cu, Al, Zr, Ga, B and F were measured. In order to measure the contents of the 14 elements, the standard samples, spectroscopic crystals and X-rays shown in Table 3 were used. Before the quantitative analysis, a peak was searched in advance by use of a standard sample and the position of the peak was fixed. The time for the quantitative analysis was specified as 40 seconds at the peak position. And the time for the quantitative analysis of backgrounds was specified as 10 seconds at each position of the both ends of the peak.

Point analysis for 5 R—O—C—N concentrated parts at each depth was carried out, and then, the O/R ratio, N/R ratio and RH/R ratio (measurement point on the surface, alone) with respect to each measurement point were calculated. Then, analysis results showing the largest value of a parameter and the smallest value thereof were eliminated and the analysis results of three points were averaged. In this manner, the O/R atomic ratio and N/R atomic ratio at each depth, and the RH/R atomic ratio in the R—O—C—N concentrated parts present in the surface were calculated. Further, ΔO/R(S) and ΔO/R(300) were calculated. Moreover, the area proportions of the R—O—C—N concentrated parts in the surface and the center were calculated. Note that, during point analysis by an EPMA, care was taken such that C was not excessively re-deposited in R—O—C—N concentrated parts. The results are shown in Table 2. In Table 2, the RH/R atomic ratio of the R—O—C—N concentrated parts present in the surface was simply described as "surface RH/R ratio (atomic ratio)". It was confirmed that the concentrations of R, O, C and N in the R—O—C—N concentrated parts are all higher than those in the main phase grains.

TABLE 1

| Sample No. | Oxidation of R—O—C—N concentrated part: Coating material (oxide) | Coating amount [wt %] | Heat treatment temperature [° C.] | RH element diffusion: Coating material (RH compound) | Magnetic properties and RH content: Br [mT] | HcJ [kA/m] | RH content [wt %] |
|---|---|---|---|---|---|---|---|
| Comparative Example 1 | None | None | None | Tb hydride | 1446 | 1797 | 0.38 |
| Comparative Example 2 | None | None | None | Tb oxide | 1447 | 1730 | 0.33 |
| Comparative Example 3 | Tb oxide | 1.0 | 900 | Tb hydride | 1348 | 2030 | 1.21 |
| Example 1 | Nd oxide | 0.2 | 900 | Tb hydride | 1445 | 1898 | 0.41 |
| Example 2 | Nd oxide | 0.5 | 900 | Tb hydride | 1443 | 1929 | 0.57 |
| Example 3 | Nd oxide | 0.7 | 900 | Tb hydride | 1441 | 1963 | 0.59 |
| Example 4 | Nd oxide | 1.0 | 900 | Tb hydride | 1438 | 1990 | 0.60 |
| Example 5 | Nd oxide | 1.2 | 900 | Tb hydride | 1424 | 1911 | 0.62 |
| Example 6 | Nd oxide | 1.5 | 900 | Tb hydride | 1410 | 1904 | 0.63 |
| Example 7 | Nd oxide | 1.0 | 850 | Tb hydride | 1443 | 1948 | 0.60 |
| Example 8 | Nd oxide | 1.0 | 890 | Tb hydride | 1439 | 1972 | 0.60 |
| Example 9 | Nd oxide | 1.0 | 950 | Tb hydride | 1442 | 1949 | 0.60 |
| Example 10 | Didymium oxide | 1.0 | 900 | Tb hydride | 1403 | 1995 | 0.60 |
| Example 11 | Pr oxide | 1.0 | 900 | Tb hydride | 1397 | 2001 | 0.60 |
| Example 12 | Nd oxide | 1.0 | 900 | Tb oxide | 1441 | 1979 | 0.54 |
| Example 13 | Nd oxide | 1.0 | 900 | Tb fluoride | 1439 | 1986 | 0.57 |
| Example 14 | Nd oxide | 1.5 | 1000 | Tb hydride | 1416 | 1829 | 0.38 |

TABLE 2

| Sample No. | Surface: RH/R ratio (atomic ratio) | O/R ratio (atomic ratio): Surface O/R(S) | 200 μm | 300 μm O/R (300) | 400 μm | Center O/R(C) | ΔO/R(S) | ΔO/R(300) |
|---|---|---|---|---|---|---|---|---|
| Comparative Example 1 | Beyond 0.2 | 0.41 | 0.41 | 0.41 | 0.41 | 0.41 | 0.00 | 0.00 |
| Comparative Example 2 | Beyond 0.2 | 0.64 | 0.57 | 0.52 | 0.40 | 0.41 | 0.23 | 0.11 |
| Comparative Example 3 | Beyond 0.2 | 0.66 | 0.59 | 0.53 | 0.40 | 0.41 | 0.25 | 0.12 |
| Example 1 | 0.2 or less | 0.51 | 0.43 | 0.42 | 0.41 | 0.41 | 0.10 | 0.01 |
| Example 2 | 0.2 or less | 0.56 | 0.54 | 0.44 | 0.42 | 0.41 | 0.15 | 0.03 |
| Example 3 | 0.2 or less | 0.58 | 0.56 | 0.44 | 0.42 | 0.41 | 0.17 | 0.03 |
| Example 4 | 0.2 or less | 0.65 | 0.58 | 0.57 | 0.42 | 0.41 | 0.24 | 0.16 |
| Example 5 | 0.2 or less | 0.68 | 0.62 | 0.57 | 0.53 | 0.41 | 0.27 | 0.16 |
| Example 6 | 0.2 or less | 0.74 | 0.65 | 0.61 | 0.56 | 0.41 | 0.33 | 0.20 |
| Example 7 | 0.2 or less | 0.60 | 0.59 | 0.53 | 0.43 | 0.41 | 0.19 | 0.12 |
| Example 8 | 0.2 or less | 0.65 | 0.58 | 0.59 | 0.42 | 0.41 | 0.24 | 0.18 |
| Example 9 | 0.2 or less | 0.79 | 0.72 | 0.65 | 0.43 | 0.41 | 0.38 | 0.24 |
| Example 10 | 0.2 or less | 0.65 | 0.59 | 0.57 | 0.42 | 0.41 | 0.24 | 0.16 |
| Example 11 | 0.2 or less | 0.66 | 0.58 | 0.57 | 0.43 | 0.41 | 0.25 | 0.16 |
| Example 12 | 0.2 or less | 0.75 | 0.65 | 0.60 | 0.57 | 0.41 | 0.34 | 0.19 |
| Example 13 | 0.2 or less | 0.64 | 0.57 | 0.55 | 0.42 | 0.41 | 0.23 | 0.14 |
| Example 14 | 0.2 or less | 0.79 | 0.77 | 0.70 | 0.61 | 0.42 | 0.37 | 0.28 |

| Sample No. | Area proportion of R—O—C—N concentrated part (%): Surface | Center | N/R ratio (atomic ratio): Surface N/R(S) | 200 μm | 300 μm | 400 μm | Center N/R(C) |
|---|---|---|---|---|---|---|---|
| Comparative Example 1 | 3 | 3 | 0.60 | 0.60 | 0.60 | 0.60 | 0.60 |
| Comparative Example 2 | 3 | 3 | 0.25 | 0.51 | 0.55 | 0.60 | 0.60 |
| Comparative Example 3 | 4 | 3 | 0.24 | 0.49 | 0.54 | 0.60 | 0.60 |
| Example 1 | 3 | 3 | 0.48 | 0.50 | 0.60 | 0.60 | 0.60 |
| Example 2 | 3 | 3 | 0.38 | 0.41 | 0.60 | 0.60 | 0.60 |
| Example 3 | 3 | 3 | 0.30 | 0.48 | 0.60 | 0.60 | 0.60 |
| Example 4 | 3 | 3 | 0.25 | 0.51 | 0.50 | 0.60 | 0.60 |
| Example 5 | 4 | 3 | 0.24 | 0.37 | 0.42 | 0.54 | 0.60 |
| Example 6 | 5 | 3 | 0.21 | 0.32 | 0.39 | 0.51 | 0.60 |
| Example 7 | 3 | 3 | 0.35 | 0.54 | 0.55 | 0.60 | 0.60 |
| Example 8 | 3 | 3 | 0.25 | 0.51 | 0.51 | 0.60 | 0.60 |
| Example 9 | 4 | 3 | 0.20 | 0.31 | 0.35 | 0.60 | 0.60 |
| Example 10 | 3 | 3 | 0.25 | 0.51 | 0.50 | 0.60 | 0.60 |
| Example 11 | 3 | 3 | 0.25 | 0.50 | 0.50 | 0.60 | 0.60 |
| Example 12 | 3 | 3 | 0.20 | 0.30 | 0.40 | 0.50 | 0.60 |
| Example 13 | 3 | 3 | 0.26 | 0.52 | 0.50 | 0.60 | 0.60 |
| Example 14 | 7 | 4 | 0.13 | 0.24 | 0.32 | 0.37 | 0.59 |

TABLE 3

| Element | Standard sample | Dispersive crystal | X-rays |
|---|---|---|---|
| C | C | LDE2 | Kα line |
| N | BN | LDE2 | Kα line |
| O | $SiO_2$ | LDE1H | Kα line |
| Nd | $NdP_5O_{14}$ | LIF | Lα line |
| Pr | $PrP_5O_{14}$ | LIF | Lα line |
| Tb | $TbF_3$ | LIFH | Lα line |
| Fe | Fe | LIF | Kα line |
| Co | Co | LIFH | Kα line |
| Cu | Cu | LIFH | Kα line |
| Al | $Al_2O_3$ | TAPH | Kα line |
| Zr | Zr | PETH | Lα line |
| Ga | GaP | TAPH | Lα line |
| B | BN | LDE6H | Kα line |
| F | $CaF_2$ | TAP | Kα line |

Examples 1 to 6 and Comparative Example 1 were carried out in the same conditions except that the applied amount of an Nd oxide during oxidation of R—O—C—N concentrated parts was varied. Example 14 was carried out in the same manner as in Example 6 except that the temperature of the heat treatment during oxidation of R—O—C—N concentrated parts was set to be high. Comparative Example 2 was carried out in the same conditions as in Comparative Example 1 except that the Tb hydride was changed to a Tb oxide. As shown in Examples 1 to 6 and 14, preferable magnetic properties were obtained if R—O—C—N concentrated parts were oxidized before an RH element was diffused. In contrast, as shown in Comparative Example 1 and Comparative Example 2, residual magnetic flux density Br or coercivity HcJ were inferior to those of Examples if R—O—C—N concentrated parts were not oxidized before an RH element was diffused. In Examples 2 to 5 where the applied amount of an Nd oxide was suitably controlled, residual magnetic flux density Br and/or coercivity HcJ were superior to those in Examples 1, 6 and 14. In Examples 3 and 4, particularly excellent coercivity HcJ was obtained compared to Examples 1, 2, 5, 6 and 14. The coercivity HcJ of Example 6 was excellent compared to Example 14. This is considered because the temperature of the heat treatment during oxidation of R—O—C—N concentrated parts was suitably controlled in Example 6 compared to Example 14, with the result that the area proportion of the R—O—C—N concentrated parts in the surface was suitably controlled.

In Comparative Example 1, it is considered that since R—O—C—N concentrated parts were not oxidized, RH was not sufficiently diffused into grain boundaries, with the result that coercivity HcJ was lower than Examples. In Comparative Example 2, since a Tb oxide was diffused, the O/R ratio of R—O—C—N concentrated parts was similar to those in Examples. However, since the R—O—C—N concentrated parts were not oxidized, a large amount of RH was incorporated particularly in the R—O—C—N concentrated parts present in the surface of the magnet. For this reason, it was considered that particularly coercivity HcJ is lower than Examples.

In Examples 7 to 9, the temperature of the heat treatment during oxidation of R—O—C—N concentrated parts was changed from that of Example 4. Even if the temperature of the heat treatment was changed, suitable magnetic properties were obtained. In Example 4 and Example 8 where the temperature of the heat treatment was suitably controlled, coercivity HcJ was particularly excellent, compared to Example 7 and Example 9.

In Examples 10 and 11 and Comparative Example 3, a coating material during oxidation of R—O—C—N concentrated parts was changed from that of Example 4. In Example 10 and Example 11 where a light rare earth element compound was used as the coating material, excellent magnetic properties were obtained. In contrast, in Comparative Example 3 where a Tb oxide was used as the coating material, the RH/R ratio in the surface was excessively high, with the result that the residual magnetic flux density Br was markedly low. If a large amount of RH is used, manufacturing cost increases. Because of this, the manufacturing cost of Comparative Example 3 was high compared to other Examples and Comparative Examples.

In Examples 12 and 13, a coating material during the RH element diffusion time was changed from that of Example 4. Satisfactory magnetic properties were obtained even if the coating material was changed from a Tb hydride to a Tb oxide or a Tb fluoride.

Note that, RH concentration distribution was measured by EPMA line analysis in all Examples. As a result, it was confirmed that a heavy rare earth element was distributed such that the concentration thereof increased from the center toward the surface of an R-T-B based permanent magnet.

DESCRIPTION OF THE REFERENCE NUMERAL

1 . . . R-T-B based permanent magnet
3 . . . R—O—C—N concentrated part
5 . . . Main phase grains
7 . . . Grain boundaries
12 . . . Magnetic pole face
14 . . . Measurement sample
16 . . . Observation surface
21 . . . Ion beam processed section
23 . . . Ion beam processed surface
31 . . . Ion gun of FIB
33 . . . Electron gun of SEM
35 . . . Sample stage

What is claimed is:

1. An R-T-B based permanent magnet, in which R represents a rare earth element, T represents an iron group element and B represents boron, wherein the R-T-B based permanent magnet comprises main phase grains including an $R_2T_{14}B$ crystal phase and grain boundaries formed between the main phase grains;

the grain boundaries include R—O—C—N concentrated parts where the concentrations of R, O, C and N are all higher than those in the main phase grains;

the following Expression (1) is satisfied;

$$O/R(S)>O/R(C) \quad \text{Expression (1)}$$

in which O/R(S) represents an average O/R ratio (atomic ratio) in the R—O—C—N concentrated parts present in a surface region of the R-T-B based permanent magnet and O/R(C) represents an average O/R ratio (atomic ratio) in the R—O—C—N concentrated parts present in a center region of the R-T-B based permanent magnet;

R includes at least a heavy rare earth element RH and at least a rare earth element other than a heavy rare earth element in the R-T-B based permanent magnet; and wherein the R—O—C—N concentrated parts present in the surface region of the R-T-B based permanent magnet have an average RH/R ratio (atomic ratio) of 0.2 or less, the surface region of the R-T-B based permanent magnet is a region within a range from a surface of the R-T-B based permanent magnet to a depth of 50 μm, a distance between two magnetic pole faces of the R-T-B based permanent magnet is represented by d, and the center region of the R-T-B based permanent magnet is a region within a distance from one of the magnetic pole faces satisfying (d/2)±(d/10); and the R-T-B based permanent magnet has a Br of 1390 mT or more and a HcJ of 1800 kA/m or more.

2. The R-T-B based permanent magnet according to claim 1, wherein ΔO/R(S)≥0.10 is satisfied, in which ΔO/R(S)=O/R(S)−O/R(C).

3. The R-T-B based permanent magnet according to claim 1, wherein ΔO/R(S)≥0.20 is satisfied, in which ΔO/R(S)=O/R(S)−O/R(C).

4. The R-T-B based permanent magnet according to claim 1, wherein ΔO/R(S)=0.38 or less is satisfied in which ΔO/R(S)=O/R(S)−O/R(C).

5. The R-T-B based permanent magnet according to claim 1, wherein ΔO/R(300)≥0.01 is satisfied in which ΔO/R(300)=O/R(300)−O/R(C) and O/R(300) represents an average O/R atomic ratio in the R—O—C—N concentrated parts present at a depth of 300 μm from the surface of the R-T-B based permanent magnet.

6. The R-T-B based permanent magnet according to claim 1, wherein ΔO/R(300)>0.10 is satisfied in which ΔO/R(300)=O/R(300)−O/R(C) and O/R(300) represents an average O/R atomic ratio in the R—O—C—N concentrated parts present at a depth of 300 μm from the surface of the R-T-B based permanent magnet.

7. The R-T-B based permanent magnet according to claim 1, wherein ΔO/R(300)=0.28 or less is satisfied in which ΔO/R(300)=O/R(300)−O/R(C) and O/R(300) represents an average O/R atomic ratio in the R—O—C—N concentrated parts present at a depth of 300 μm from the surface of the R-T-B based permanent magnet.

8. The R-T-B based permanent magnet according to claim 1, wherein the heavy rare earth element is distributed such that the concentration thereof increases from the center region toward the surface of the R-T-B based permanent magnet.

9. The R-T-B based permanent magnet according to claim 1, wherein the following Expression (2) is satisfied;

$$N/R(S)<N/R(C) \qquad \text{Expression (2)}$$

in which N/R(S) represents an average N/R ratio (atomic ratio) in the R—O—C—N concentrated parts present in the surface region of the R-T-B based permanent magnet and N/R(C) represents an average N/R ratio (atomic ratio) in the R—O—C—N concentrated parts present in the center region of the R-T-B based permanent magnet.

10. The R-T-B based permanent magnet according to claim 1, wherein area proportions of R—O—C—N concentrated parts in the surface region and the center region of the R-T-B based permanent magnet are 3 to 5%.

11. The R-T-B based permanent magnet according to claim 1, wherein the R-T-B based permanent magnet has a Br of 1420 mT or more and a HcJ of 1900 kA/m or more.

12. The R-T-B based permanent magnet according to claim 11, wherein the HcJ of 1950 kA/m or more.

* * * * *